US005898953A

United States Patent [19]

Paxon

[11] Patent Number: 5,898,953

[45] Date of Patent: May 4, 1999

[54] RISING SEAT FOR SEATING INCLUDING TOILETS

[76] Inventor: John B. Paxon, 123 Abbey Foregate, Shrewsbury SY2 6AZ, United Kingdom

[21] Appl. No.: 08/750,281

[22] PCT Filed: May 24, 1994

[86] PCT No.: PCT/GB94/01134

§ 371 Date: Nov. 22, 1996

§ 102(e) Date: Nov. 22, 1996

[87] PCT Pub. No.: WO95/31953

PCT Pub. Date: Nov. 30, 1995

[30] Foreign Application Priority Data

Nov. 16, 1992 [GB] United Kingdom ..... 9223956

[51] Int. Cl.[6] ..... A47K 13/04

[52] U.S. Cl. ..... 4/248; 4/241; 297/DIG. 10

[58] Field of Search ..... 4/248, 241, 237, 4/246.1, 246.3, 246.5; 297/DIG. 10

[56] References Cited

U.S. PATENT DOCUMENTS

| | | | |
|---|---|---|---|
| 2,812,522 | 11/1957 | Wilson | 4/241 |
| 3,158,398 | 11/1964 | Stryker | 297/DIG. 10 |
| 3,659,897 | 5/1972 | Wright | 297/DIG. 10 |
| 4,428,083 | 1/1984 | Chuang | 4/248 |
| 5,116,100 | 5/1992 | Iversen | 297/DIG. 10 |
| 5,243,738 | 9/1993 | Kiefer | 4/241 |
| 5,316,370 | 5/1994 | Newman | 297/DIG. 10 |
| 5,333,931 | 8/1994 | Weddendorf | 297/DIG. 10 |
| 5,341,518 | 8/1994 | Uhl | 4/241 |

*Primary Examiner*—David J. Walczak

[57] ABSTRACT

A Rising Seat that can be fixed permanently to a seat or toilet and which can also be readily adapted as a portable seat. It comprises a top rising section on which the user sits, pivoted to a bottom section. There is at least one torsion spring located on a torsion bar that may also act as a hinge. When the legs of any selected number of springs are placed in spaces/openings incorporated in the seat, those springs become inoperable having been moved away from firm surfaces on the rising seat against which they give resilience to the top section. This enables adjustment to be made to suit the weight of the user, and when the legs of all the springs are placed in the spaces/openings the top section can be folded down without resilience for carriage and storage and to give the appearance of a standard seat cushion when not in use.

16 Claims, 11 Drawing Sheets

RISING SEAT FOR SEATING INCLUDING TOILETS

BACKGROUND TO THE INVENTION

The present invention relates to a rising seat for chairs and settees and which can be readily adapted for use on toilets for handicapped people. Most rising seats or lift seats by which name they are widely known, are fitted to a frame on a chair and are operated by a spring or gas mechanism, the angle and bulk of which is easily fitted into an existing chair where ample space permits bulky and at times heavy mechanisms to be used, and they are usually assembled during the manufacture of the furniture for which they are designed. For examples T. Wear Smith U.K. 2193886 teaches a torsion spring, the end of which is coiled around and fixed to two torsion bars, one being moveable by threading a bolt into the bar to move the bar and force the spring upwards to increase its tension. Renray 1,578,395 teaches a number of springs, one leg of each having fixed to it an adjustment means, the selected springs being inoperable by inserting a screw into adjustment means and forcing the spring legs away from the pivoted seat, thereby adjusting the resilience required for a predetermined load. A Portable lift seat—1,475,561, invented by a certain LASTINGENS INKOPSCENTRAL LIC EKONOMISK FORENSING, a Swedish corporate teaches an 'auxilliary seat' comprising a 'U'-shaped & resilient spring locking wire pivotly mounted at its inner end portions for pivotting in a plane essentially parallel with the base board so that outward swing of the one or other limb causing bending of the spring locking wire thereby tending to displace its middle portion from a locking position to a free position etc etc etc. . . . emphasis being placed on the method by which a top rising section may be released and then locked to a downwards position, and how springs can be removed or added by the user. It would appear to be very useful for a sitter who wishes to change his mind about rising from the seat and decides instead to remain seated.

The advantage of a portable lift seat; providing it is fairly simple in its construction and which can be adjusted easily by the user to suit his weight without the need to have a supply of additional springs or other parts to fix to the riser seat, and which can be kept stable on a chair seat for example, include: the practical and economic aspects of using an existing chair without having to purchase a more expensive chair with built-in lift-seat mechanism and, being portable and easily adjustable preferably it can be used in most chairs in the users house, and can even be carried on a journey for use in seating provided by other people. The current invention is easily adjustable without the use of a tool whether permanently or releaseably fixed to a chair or settee.

SUMMARY OF THE INVENTION

The object of the invention is to provide a rising seat and one that raises the sitter easily from a sitting position and which lowers him gently into a sitting position from a standing and which can be so located on an existing seat in a manner to ensure its stability when in use and one that can be readily adapted to suit the weight of most users, without removal or replacement of working parts.

According to the invention there is provided a rising seat for seating and toilets comprising in combination at least one torsion spring on a torsion bar, each leg of any selected spring being activated by its at least indirect contact with the inside surface of the rising seat's top and bottom sections said sections being pivotly-hinged together, and a means of rendering any selected number of springs ineffective by removing the pressure from the spring legs and then positioning a leg of each spring not required into one of any number of openings localised on at least one of the sections, such positioning/s preventing the top section from activating the said-positioned springs and so governing the degree of ease at which the top section is lowered on to the bottom section and enabling the user to select only the springs required to render the top section resilient enough to lower him gently into a sitting position and to raise him from a sitting position to a standing position. The degree of ease at which the top section is lowered may be governed by moving the torsion bar on which the spring/s is/are placed, and the mechanism can be applied to a lift seat permanently fixed to seating or toilets. It incorporates a means of lowering the top section on to the bottom section free of resilience, for carrying if portables or to give the appearance of a standard seat. The rising seat may have attached to its surface a suitable carrying handle. It may have a method of locking it down against the resilience of the spring and a method of adjustment to enable it to remain stable and effective irrespective of the width and depth of the seat in which it is placed. The invention shall now be described by way of example only by the following drawings in which:

DESCRIPTION OF THE PREFERRED EMBODIMENTS

Figure 1:
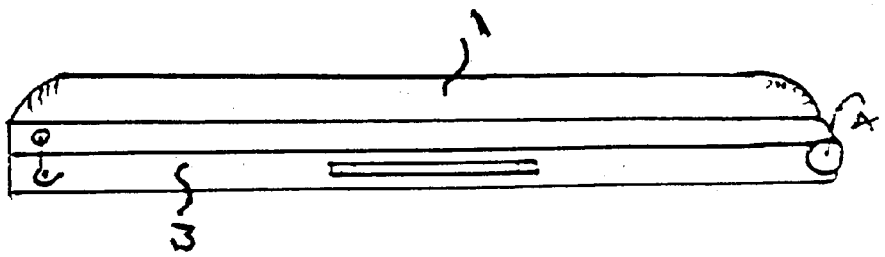
FIG. 1 is a side view of rising seat in a low position when not in use.
Figure 2:
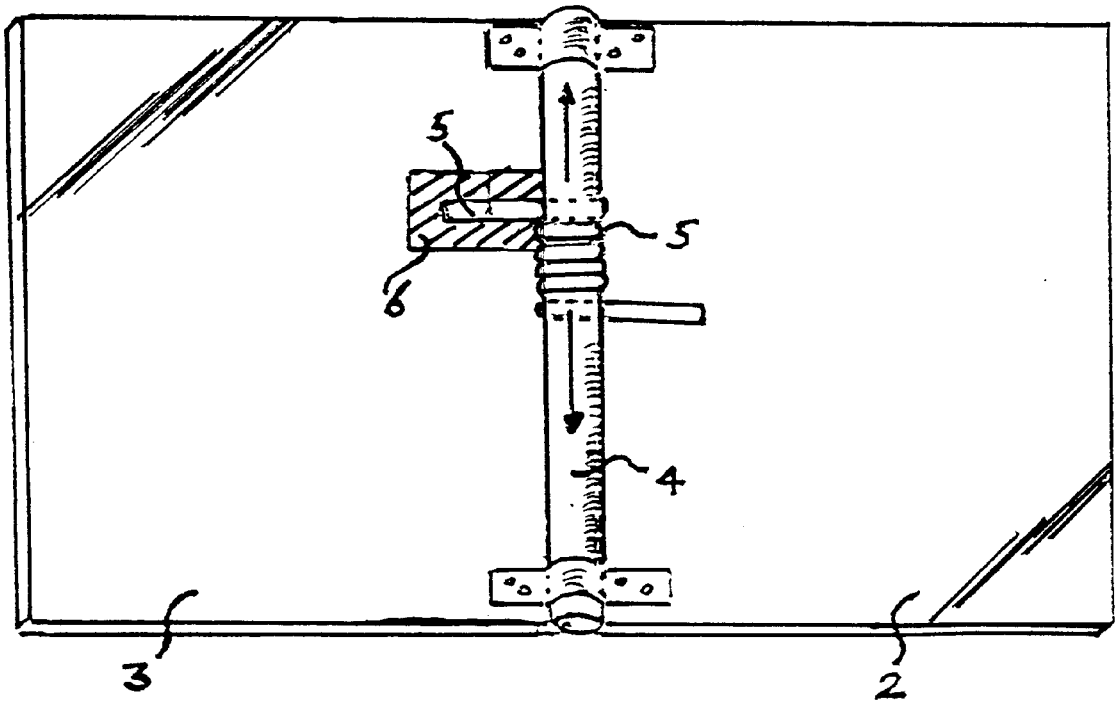
FIG. 2 is a bottom underside view in perspective of top section of a rising seat that shows method of adjustment to a neutral position that enables top section to be lowered without resilience from the spring/s.
Figure 3:
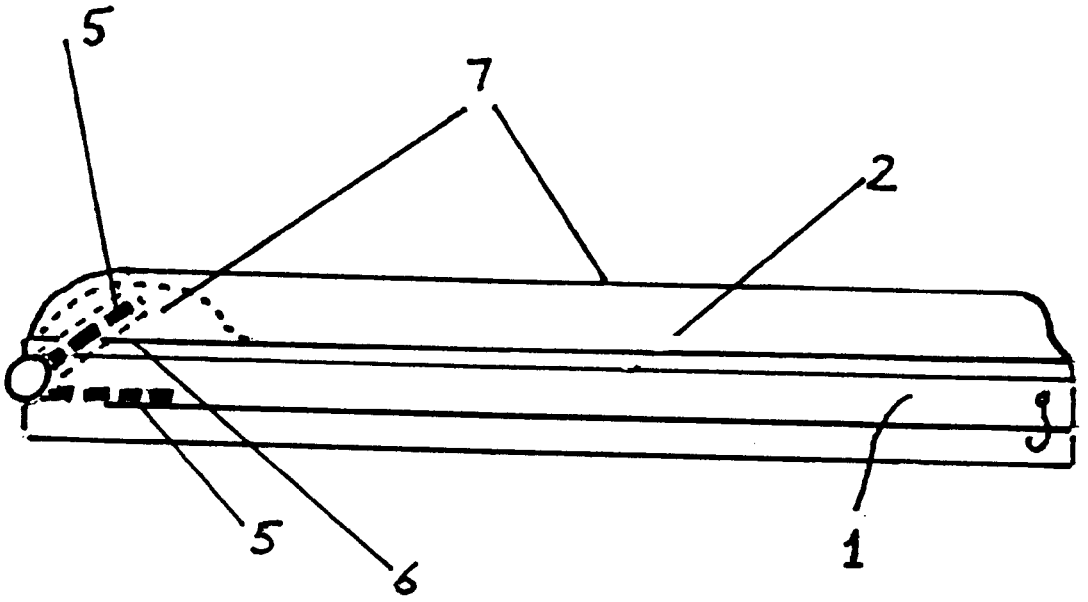
FIG. 3 shows an open plan view in which a spring leg travels into a cavity over which it has been positioned when pressure is away from the spring leg, the cavity being in the top section, said cavity being covered.
Figure 4:
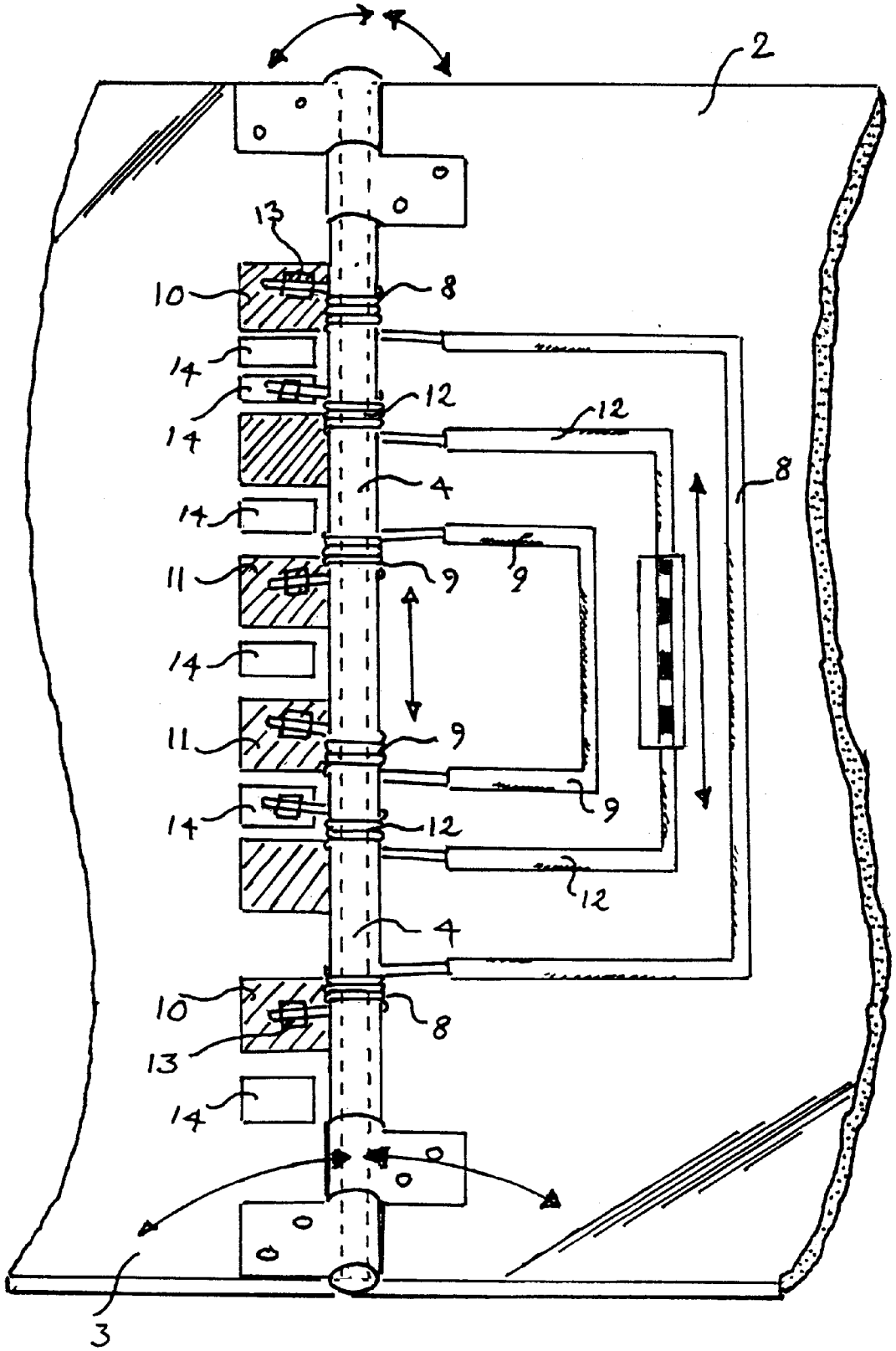
FIG. 4 is an underside view of top section opened out to expose both sections shows method of substituting a weaker spring mechanism for example for a stronger one.
Figure 5:
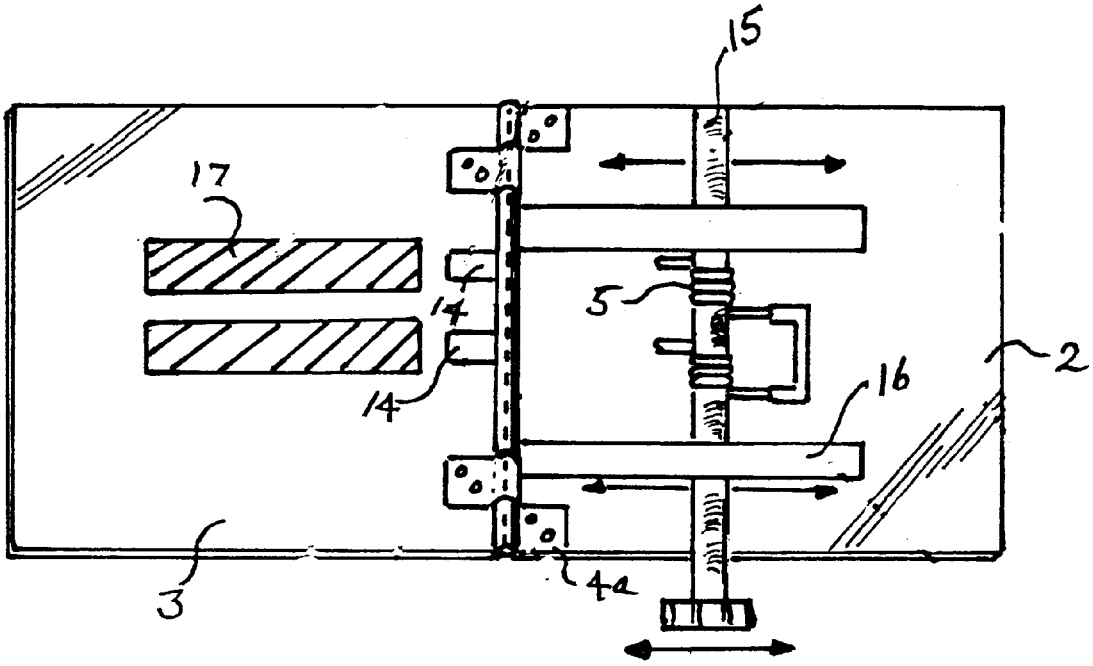
FIG. 5 is an underside view when top section is opened out with the bottom section of the rising seat. Neutralising the torsion spring is shown by moving the torsion bar on which the spring/s is/are located.
Figure 6:
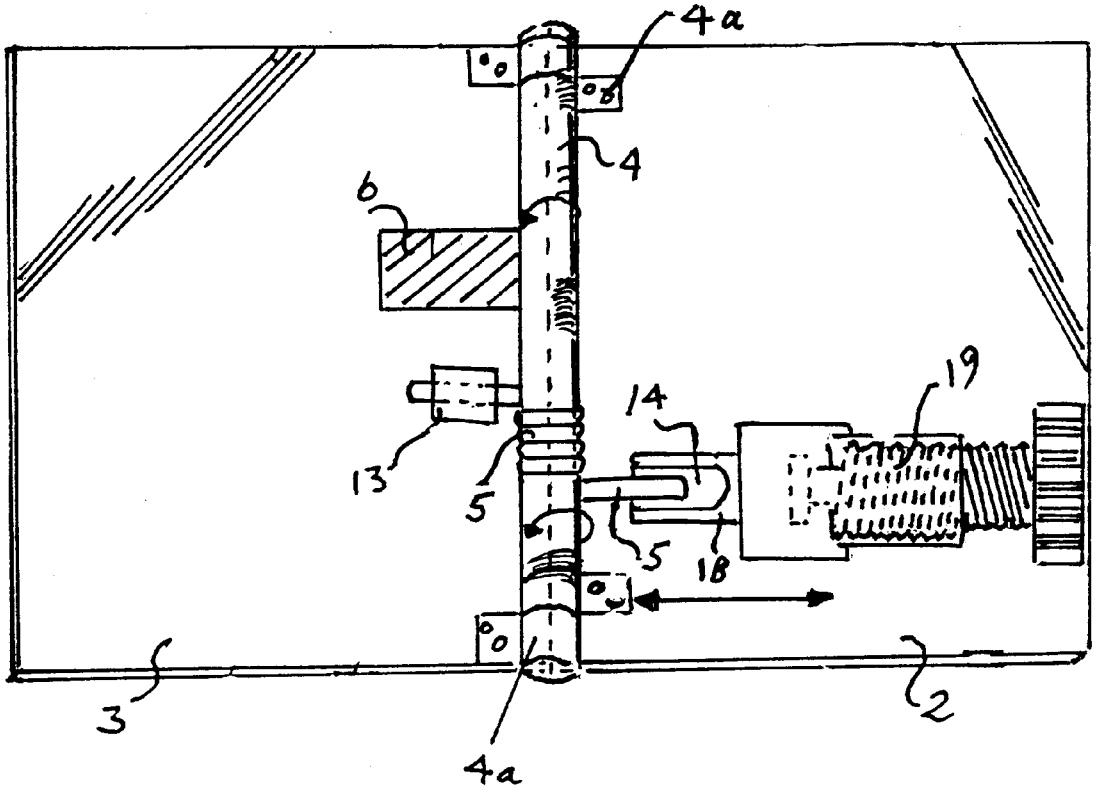
FIG. 6 is an underside view—shows the method of increasing or decreasing the strength of a torsion spring.
Figure 7:
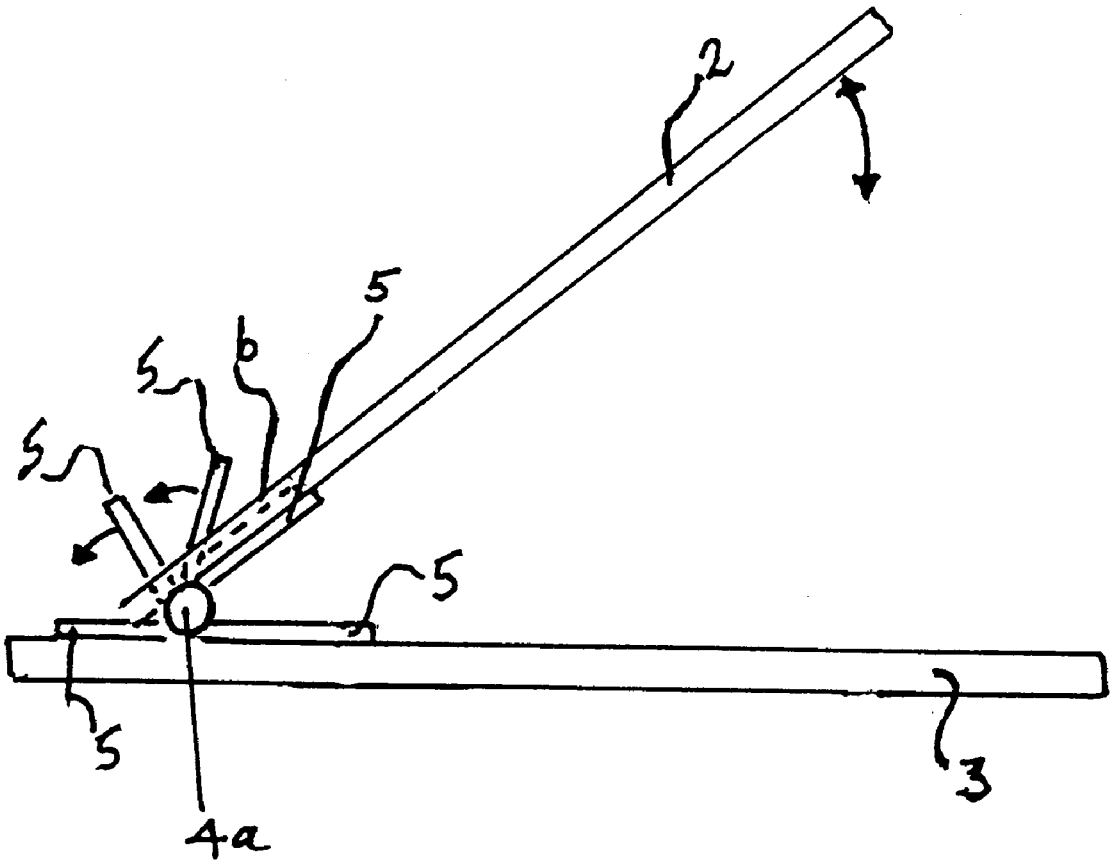
FIG. 7 is a side view open plan of torsion bar fixed away from edge of bottom section.
Figure 8:
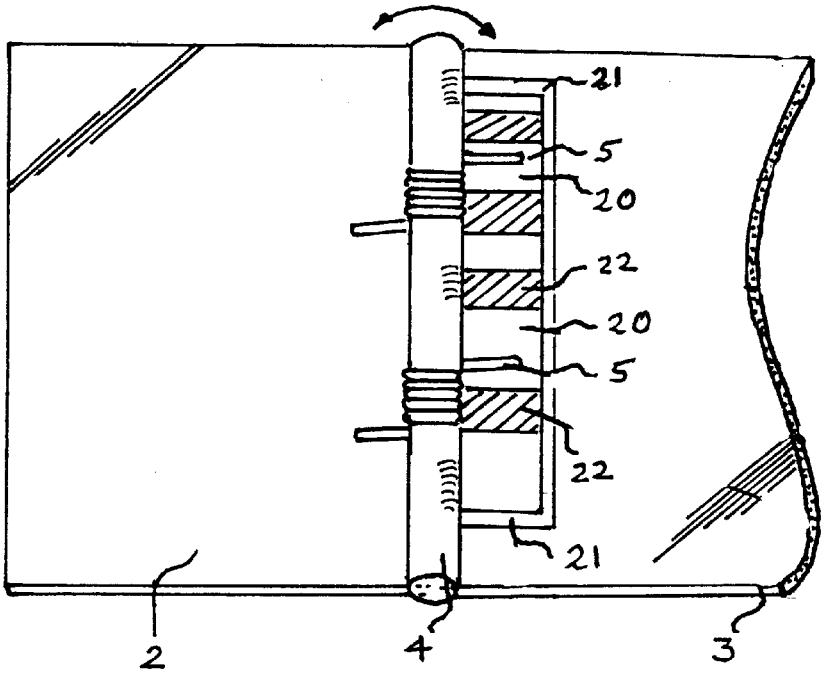
FIG. 8 is a top view of method of determining the ease at which top section can be lowered using sliding base.
Figure 9:
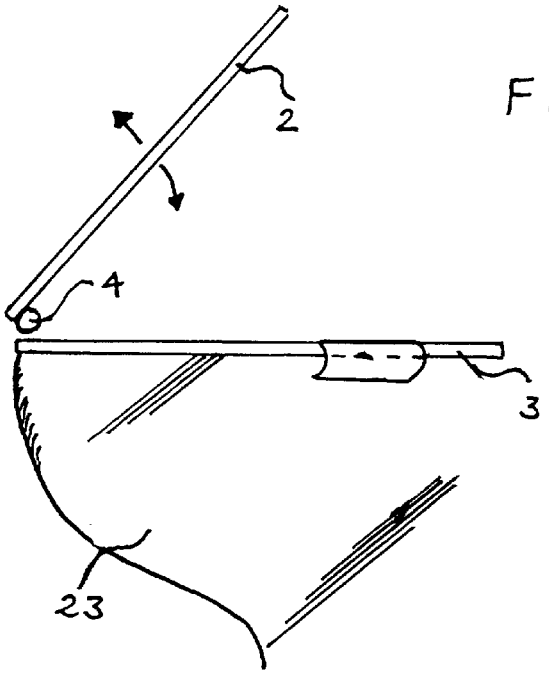
FIG. 9 is a side view of hollowed out top section hinged on bottom section, or directly on to toilet.
Figure 10:
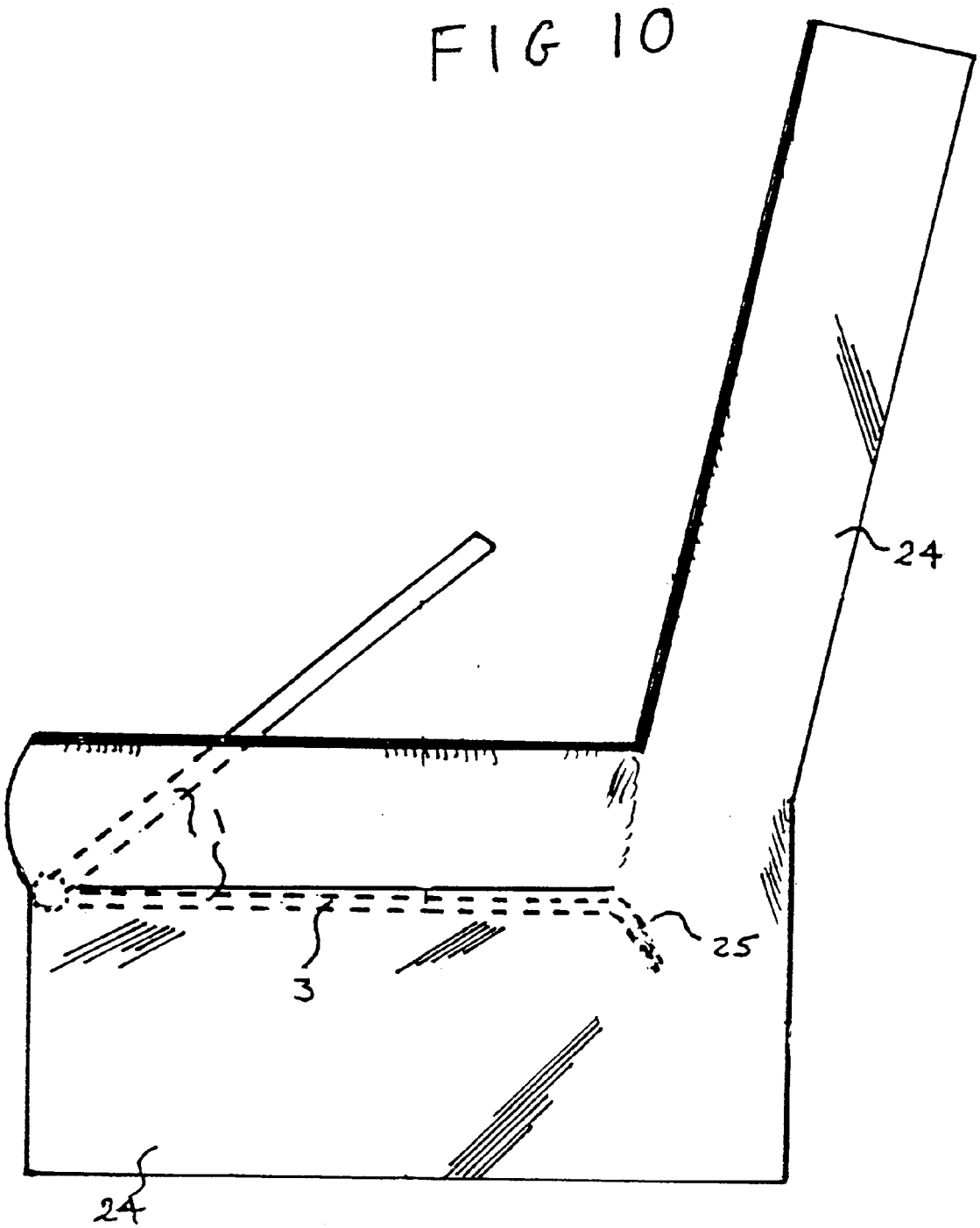
FIG. 10 shows a side view in open plan of rising seat located in a chair by tongue-shaped extension to the bottom section.
Figure 11:
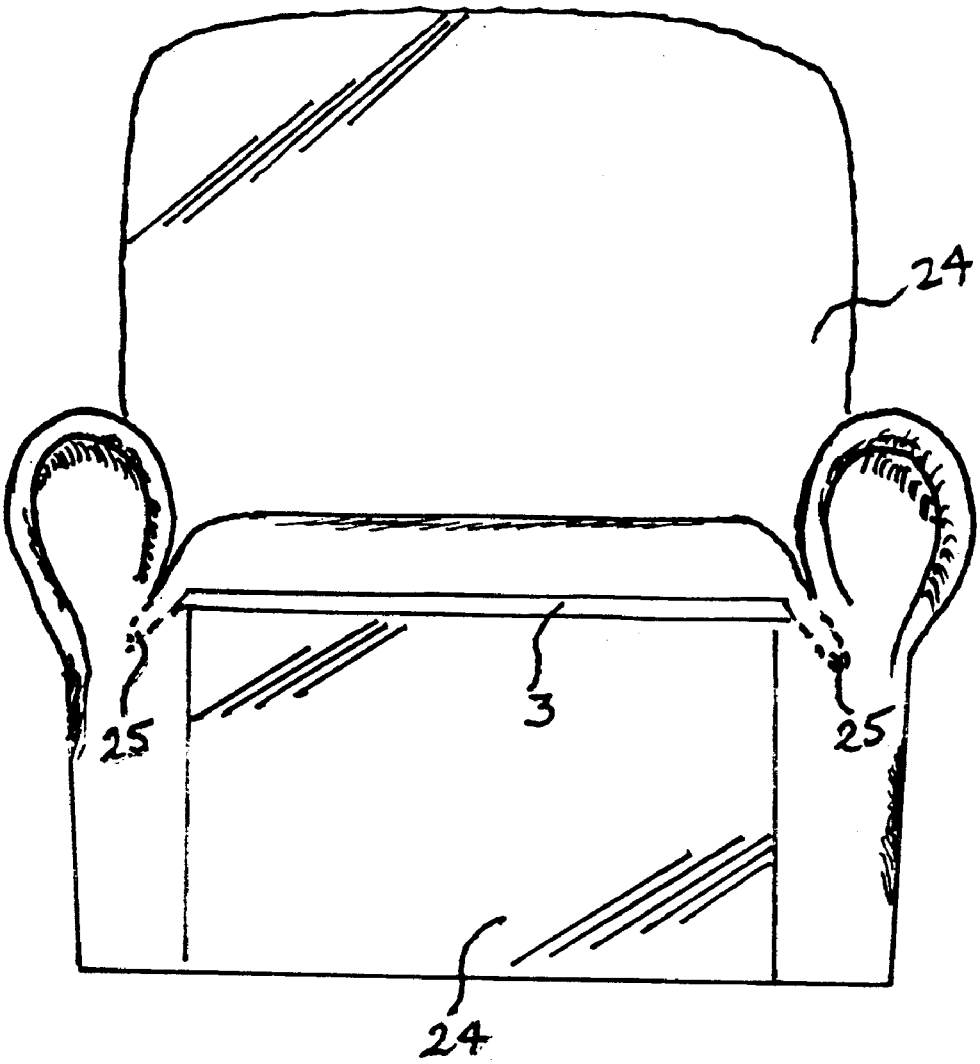
FIG. 11 shows open plan view of chair from front with bottom section of rising seat incorporating extended sides shaped to fit under arms of chair.
Figure 12:
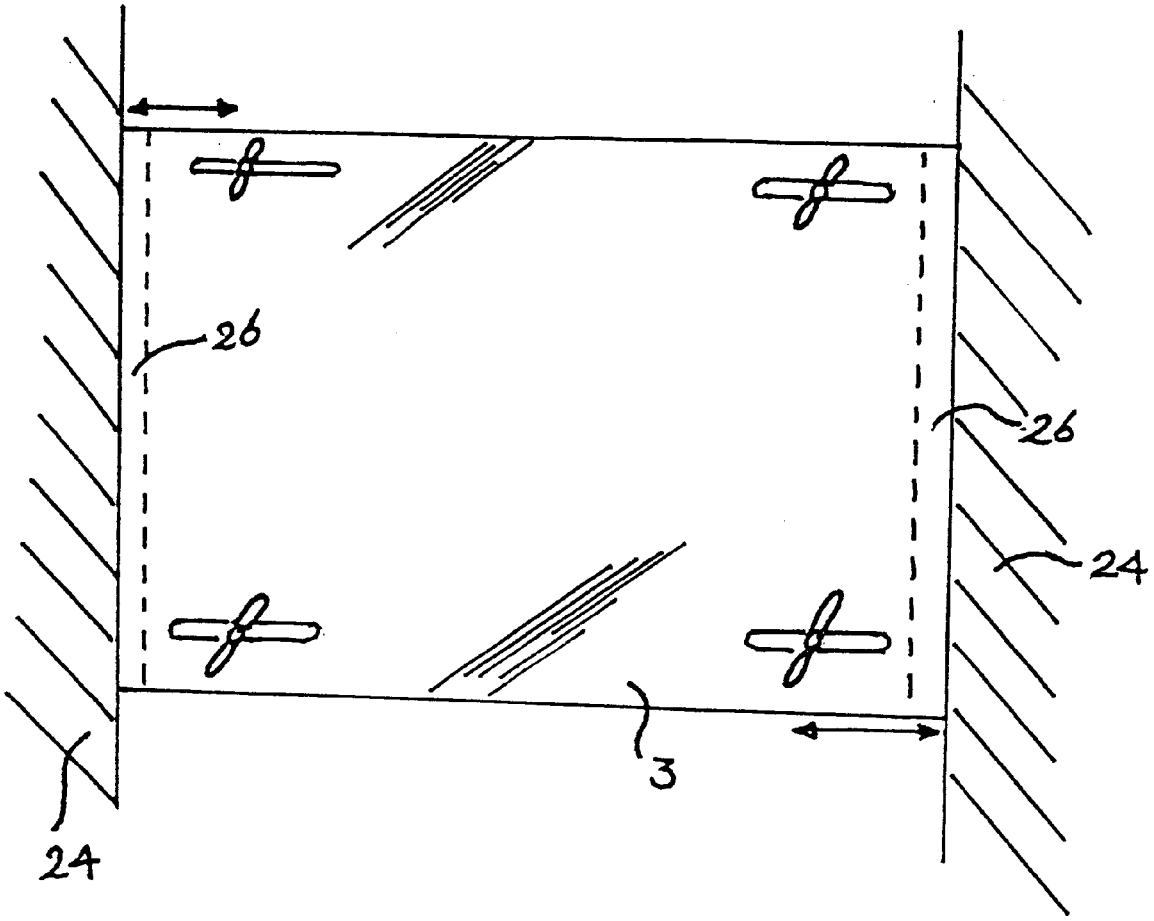
FIG. 12 shows underside view of bottom section with extendable sides to fit a wide chair.
Figure 13:
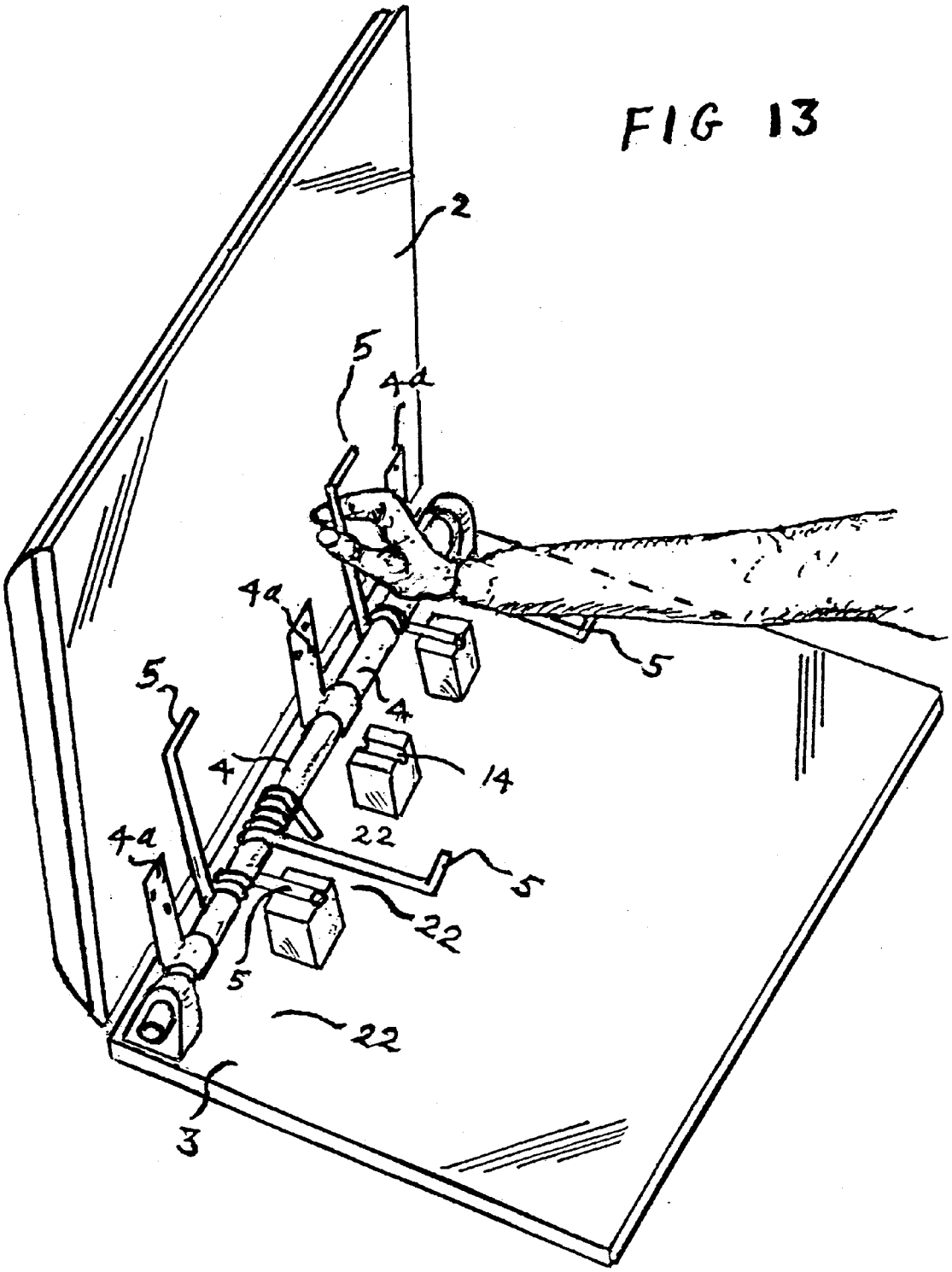
FIG. 13 shows a user manipulating the springs on the rising seat.

FIG. 1 shows seat 1 folded for carrying. The top section 2 of the rising seat shown as 2 may be lowered or folded or hinged down on to the bottom section 3 after neutralizing the resilient action of the torsion spring that in its 'active' or positive mode is used to enable the user to lower himself gently on to the chair, the top section of the seat pivoting against the resilience of the said spring that also enables the sitter to raise himself from a sitting to a standing position. Pressure may be released from the spring by moving a part of the top and bottom sections away from the spring/s. Neutralizing the resilience of the spring is shown in FIGS. 2 and 4. The hinge-pin 4 also acts as a torsion bar that is circular and rests across the ends of either section of the riser seat. Any selected number of torsion springs 5 are placed over the bar. The main body of the spring is so coiled to leave ample room for contraction as weight is applied to the ends of the spring, one leg of each spring coming into contact, at least indirectly, with the inner face of the top section and the other leg coming into contact at least indirectly with the bottom section 3 as weight is applied and the top section 2 is pivoted downwards towards the bottom section. The angle of the torsion spring 5 is such that when the top section is opened outwards to form a configuration similar to that of an open book the spring/s can be moved along the torsion bar unhindered by the pressure of either board or section. In at least one of the boards from which the top section would preferably be made and from which the bottom section may be made and towards the surface of which one leg or two legs of the torsion spring is pointing is a cavity or opening 6 of a shape that will allow the leg or legs of the spring to fall as the top section of the rising seat is lowered. When the spring leg drops into the cavity 6—See FIG. 2—the spring then has no surface against which it can be pressed to give the spring and the top board resilience when the top section is lowered so that the top section can thus be freely lowered to rest on the bottom section enabling it to be easily carried or to be placed in a chair without the top section being raised. The cavity 6 may be covered on the opposite surface of the rising seat 1 this being shown in FIG. 3—so that the leg of the spring does not dig into the face of the rising seat cover. The spring leg can be covered by a dome-shaped cover 7 that can be placed either over the area where the spring leg 5 would otherwise protrude or the whole of the top surface 2 of the rising seat as seen can be covered and then upholstered over the hard surface surface of a larger dome-shaped cover 7. The method of neutralizing the effect of the spring can also be used for adjusting the resilience of the top section of the rising seat either by having blind hole cavities of different depths that will decrease the tension of a spring by lengthening the distance between the end of the leg or point of contact of a spring in relation to the top section or by neutralizing totally the resilience of a selected number of springs of varying strengths, and positioning only that spring or springs of a predetermined strength so that it/they become resilient only if its/their legs are positioned away from the cavities & on to a firm surface of the board around the said cavities. For example, ideally two springs would be used to raise the top section of the rising seat, such springs being joined together by a connecting wire or handle so that springs can be moved in one action by lifting the connecting wire & moving the springs connected by the connecting wire, or handle. See FIG. 4. If there are three sets of springs for example comprising two springs per set, each set can be a different thickness and strength. Two sets 8 & 9 can be located with their legs over holes 10 & 11 so that they cannot be under resilience when the top section 2 of the rising seat shown is pressed down by the weight of the user, leaving the selected spring set 12 only to be compressed on to the inner surface of the board 3 as the top section board is lowered, the pressure of the board activating the resilience of the spring set 12 selected for the resilience needed to suit the weight of the user; the selection of the springs can either be numerical or by thickness of the spring/s that could be calibrated to suit a variance in body weights. The spring can instead be located on the torsion bar 4 so that when the torsion bar or hinge-pin, if also used as a hinge-pin, on which the top section pivots on the bottom sections is moved one way or the other, it carries with it at least one spring that can, with the two boards opened out and free of pressure of the spring legs in that opened out position, be located over a cavity, so that when the top section is lowered on to the bottom section 3 no resilience is felt from that spring or set of springs in the cavities. Movement of the springs for adjustment or neutralizing the tension can be assisted by small rollers 13 on the spring legs if springs are near to the boards. Grooves are shown as 14 into which spring leg is placed to prevent slippage as shown in FIGS. 4, 5 and 6. FIG. 5: An alternative method of creating a neutral position that enables the top section to be lowered without resilience from the spring or springs is to move a separate torsion bar 15 on which the springs 5 would be located towards the centre of the board; in which the torsion bar can be fitted in a guide 16 fitted to one of the boards. As the torsion bar 15 is moved, preferably in guides 16 to stabilize its movement, so one of the ends or legs of at least one spring, depending on the number of springs placed on the torsion bar, is drawn away from one of the boards thereby neutralizing the effectiveness of the spring when the top section 2 is lowered on to the bottom section 3 of the aforesaid rising seat both spring legs of each spring resting over one board only. To enable such movement of the torsion bar on which the springs are fitted it is necessary to use the existing hinge 4*a* only for pivoting the two sections or some other form of hinge in addition to a torsion bar on which the springs are located. If positive mode is required; Return of torsion bar is assisted if spring is bent upwards. The grooves for spring legs are shown as 14. To enable the top board to be lowered on to the bottom board cavities 17 are made in the board opposite to the board on which the torsion spring/s are fitted to enable the two legs of each spring to travel through the said cavities in the said board as the board is lowered. The strengthening of individual torsion springs can be made by raising the spring 5 by locating at least one leg of the spring either directly or perhaps indirectly on a wedge-shaped base 18 with groove 14 that is moveable on the board by a screw mechanism 19 that holds the wedge in position under the spring when adjustment has been made as shown in FIG. 6 in which the top section is 2, bottom section is 3, roller 13 and cavity is 6. The top section 2 may be placed on a hinge 4*a* (see FIG. 7). The hinge being positioned two to four inches approximately away from the edge of the bottom section 3, that is to say the front edge, so that when the spring leg 5 travels through the cavity 6 the spring leg if in line or forming a large angle with its opposite leg will rest on the end of the bottom section when the top section is lowered freely without resilience from the spring, and will not jut out, from the front of the rising seat, In FIG. 8, when determining the degree of ease at which the top section 2 can be lowered on to the bottom section 3 of the rising seat shown, the spring 5 may be placed on the torsion bar 4 transversley, and spaced protrusions or blocks 20 on a sliding section 21 located under spring legs 5 selected by the user or they may be so moved away from the spring legs altogether so that the spring legs are positioned over gaps between the blocks so that when the top section is lowered on to the bottom section there is no resilience from the springs and it may be so folded down into a neutral position to facilitate its carrying. Gaps are shown as 22. Alternatively the blocks & gaps may be incorporated on a fixed section and the spring legs placed on to the blocks or over the gaps between the blocks as required by either sliding the springs along the torsion bar or by locating the springs to the torsion bar and moving the bar until the spring legs are aligned with the blocks or gaps, between the blocks as required thereby determining the degree of ease at which the top section 2 can be lowered on to the bottom section 3. The gaps may be formed from cut-outs in a solid block that may be fixed to the inside face of one, of the sections that is to say the top or bottom section or may be located to slide on one of the sections for positioning spring legs in the latter construction that would preferably be fixed transversely along the torsion bar. When used as a toilet seat 23 there shall be an opening in the top and bottom sections and at least one spring leg under the seat rim, its opposite leg resting on the toilet edge or attachment thereto. Top section 2, lower section 3 and hinge 4*a* (See FIG. 9). In FIG. 10 the rising seat 1 is kept firmly fixed to a chair 24 by a tongue-shaped extension 25 attached to or being part of the bottom section 3 of the rising seat and the extension is wedged between the seat of the chair and the vertical back of the chair 24. The same type of extension also shown as 25 in FIG. 11 can be used to protrude over the chair seat and under the arm/s such room generally being found for that purpose in most lounge-type seating and also in many types of lighter seating and chairs in which the arms are filled in to the seat of the chair the extensions ideally being placed under such arm where the arm joins the chair seat and the said extensions being fixed one on each side of the rising seat. The chair is shown as 24. In FIG. 12 the bottom section 3 of the rising seat shown can be made adjustable by having an adjustable frame 26 for example that can be moved outwards into the sides and/or back of the chair 24 in which it is resting. This adjustment facility could be affectively utilized in a chair that might be otherwise too wide for the rising seat. The sections may be padded with foam and covered by material tacked on to them.

I claim:

1. A rising seat for assisting users to raise from and lower into a seat and adapted to be used with toilets or other seating structures comprising:

a top planar section hingedly connected to a bottom planar section with at least one hinge;

at least one spring mounted between said top section and said bottom section wherein said at least one spring has one end in contact with said top section and another end in contact with said bottom section in order to enable the top section to be biased away from said bottom section; and at least one opening formed in or on one of said first or second sections whereby one of said ends of said at least one spring is movable into said at least one opening to thereby render the spring ineffective in biasing the top section away from the bottom section and enable the top section to rest against the bottom section such that when said spring ends are not positioned in said at least one opening, said top section is biased away from said bottom section to thereby assist a user to lover into and raise from a sitting position.

2. The rising seat as defined in claim 1 wherein said at least one spring is a torsion spring which is attached to at least one hinge pin that also acts as a torsion bar.

3. The rising seat as defined in claim 1 wherein said spring is a torsion spring positioned on a torsion bar wherein the torsion bar is spaced from said at least one spring.

4. The rising seat as defined in claim 3 wherein said torsion bar is movably mounted on one of said top and bottom sections in order to enable said torsion spring to be moved into and out of an operative position.

5. The rising seat as defined in claim 1 wherein said spring is slidably mounted on a hinge pin or a torsion bar.

6. The rising seat as defined in claim 1 wherein said at least one spring comprises at least two springs wherein said at least two springs are connected to each other and said at least one opening comprises at least two openings wherein said at least two springs are movably in unison into and out of a respective one of said openings.

7. The rising seat as defined in claim 1 wherein grooves are positioned in at least one of said top section and said bottom section for receiving said spring ends therein in order to prevent slippage of said at least one spring.

8. The rising seat as defined in claim 1 wherein at least one of said spring ends is positioned on a wedge whereby the wedge can be driven closer to or farther from the spring in order to adjust the tension of the spring.

9. The rising seat as defined in claim 1 wherein said bottom portion includes a tongue-shaped extension thereon adapted to be positioned against the back or sides of a chair in order to stabilize the rising seat.

10. The rising seat as defined in claim 1 wherein said bottom section includes an adjustable frame in order to adjust the width of the bottom section.

11. The rising seat as defined in claim 1 wherein said at least one hinge is spaced from an edge of said bottom section.

12. The rising seat as defined in claim 1 wherein said at least one opening is defined by blocks positioned on one of said top or bottom section.

13. The rising seat as defined in claim 12 wherein said blocks are slidably mounted on one of said top or bottom section in order to enable the position of said at least one opening to be adjusted.

14. The rising seat as defined in claim 1 wherein said top and bottom sections each have an opening therein such that said seat can be used as a toilet seat.

15. The rising seat as defined in claim 1 wherein said top and bottom sections are formed from rigid boards.

16. The rising seat as defined in claim 1 wherein said at least one spring comprises at least two springs and said at least one opening comprises at least two openings wherein said spring ends can be selectively engaged with respective openings in order to adjust the force at which said springs bias said top section from said bottom section.

* * * * *

UNITED STATES PATENT AND TRADEMARK OFFICE

CERTIFICATE OF CORRECTION

PATENT NO. : 5,898,953
DATED : May 4, 1999
INVENTOR(S) : John B. Paxon

It is certified that error appears in the above-identified patent and that said Letters Patent is hereby corrected as shown below:

Column 5, line 13, delete 'full stop' "." after 'of one'

Column 6, claim 1, line 3 –'a user to lover into and raise from a sitting position" should read – 'a user to lower into and raise from a sitting position'—

Column 6, claim 3, line 9, "torsion bar is spaced from said at least one spring' should read -- torsion bar is spaced from said at least one hinge--.

Column 6, claim 9, line 32, 'bottom portion includes a tongue-shaped extension' should read—'bottom section includes a tongue-shaped extension--

Signed and Sealed this

Fourth Day of July, 2000

*Attest:*

Q. TODD DICKINSON

*Attesting Officer*

*Director of Patents and Trademarks*